US006159053A

United States Patent [19]

Tung

[11] Patent Number: 6,159,053

[45] Date of Patent: Dec. 12, 2000

[54] ELECTRONIC CARD CONNECTOR HAVING A MOUNTING PORTION READILY MOUNTABLE TO CIRCUIT BOARD

[75] Inventor: Shun-Chi Tung, Tu-Chen, Taiwan

[73] Assignee: Hon Hai Precision Ind. Co., Ltd., Taipei Hsien, Taiwan

[21] Appl. No.: 09/348,749

[22] Filed: Jul. 6, 1999

[30] Foreign Application Priority Data

Dec. 28, 1998 [TW] Taiwan ..... 87221649

[51] Int. Cl.[7] ..... H01R 25/00

[52] U.S. Cl. ..... 439/638; 439/79; 439/636; 439/660

[58] Field of Search ..... 439/638, 660, 439/650, 653, 79, 76.1, 636

[56] References Cited

U.S. PATENT DOCUMENTS

| | | | |
|---|---|---|---|
| 3,737,833 | 6/1973 | Jerominek | 339/17 F |
| 4,850,899 | 7/1989 | Maynard | 439/628 |
| 5,129,831 | 7/1992 | Locati | 439/79 |
| 5,194,010 | 3/1993 | Dambach et al. | 439/79 |
| 5,752,857 | 5/1998 | Knights | 439/638 |
| 5,816,861 | 7/1998 | Cheng | 439/653 |
| 5,944,540 | 8/1999 | Asada et al. | 439/101 |
| 6,050,831 | 4/2000 | Wu et al. | 439/76.1 |
| 6,071,150 | 6/2000 | Tang et al. | 439/638 |

*Primary Examiner*—Paula Bradley
*Assistant Examiner*—Truc Nguyen
*Attorney, Agent, or Firm*—Wei Te Chung

[57] ABSTRACT

An electronic card connector includes a connector portion having a header retaining a plurality of first contact elements therein. Each first contact element has a first end extending beyond a first face of the header for engaging with an electronic card and a second end extending beyond a second face of the header. A mounting portion includes a housing defining a plurality of passageways between third and fourth faces thereof for receiving and retaining second contact elements therein. The second ends of the first contact elements are inserted into the passageways of the mounting portion from the third face thereof for electrically engaging with the corresponding second contact elements. A slot is defined in the fourth face of the mounting portion for receiving a circuit board. The slot is in communication with the passageways whereby the second contact elements are partially extended into the slot for electrically engaging with the circuit board. A pair of guide arms extend from the second face of the connector portion for snugly receiving and retaining the mounting portion therebetween.

1 Claim, 5 Drawing Sheets

ELECTRONIC CARD CONNECTOR HAVING A MOUNTING PORTION READILY MOUNTABLE TO CIRCUIT BOARD

BACKGROUND OF THE INVENTION

1. Field of the Invention

The present invention generally relates to an electronic card connector, and in particular to an electronic card connector for readily connecting an electronic card to an edge of a circuit board.

2. The Prior Art

An electronic card connector releasably connects an electronic card, such as a PCMCIA card, to a main board of a host machine for expansion of resources thereof. Examples of electronic card connectors are disclosed in U.S. Pat. Nos. 5,470,259 and 5,605,463 and Taiwan Patent Nos. 83110392, 84112504 and 84200350.

Conventionally, the electronic card connector is directly mounted to a circuit board by soldering contact elements of the electronic card connector to the circuit board. FIGS. 1 and 2 of the attached drawings show a conventional electronic card connector 1 directly mounted to a circuit board 2. The electronic card connector 1 comprises a plurality of contact elements 11 securely retained in an insulative housing 10. Each contact element 11 has a tail end 110 properly shaped for being soldered to a corresponding conductive pad 20 formed on the circuit board 2 thereby establishing electrical connection therebetween. The contact elements 11 are individually soldered to the circuit board 20 resulting in a complicated manufacturing process. Furthermore, the contact elements must be formed with a high degree of precision for being uniformly soldered to the circuit board.

It is thus desirable to have an electronic card connector that eliminates the problems mentioned above.

SUMMARY OF THE INVENTION

Accordingly, an object of the present invention is to provide an electronic card connector that is readily mounted to a circuit board.

Another object of the present invention is to provide an electronic card connector comprising a mounting device that is readily mounted to a circuit board for connecting the connector thereto.

To achieve the above objects, an electronic card connector in accordance with the present invention comprises a connector portion having a header retaining a plurality of first contact elements therein. Each first contact element has a first end extending beyond a first face of the header for engaging with an electronic card and a second end extending beyond a second face of the header. A mounting portion includes a housing defining a plurality of passageways therein between third and fourth faces thereof for receiving and retaining second contact elements therein. The second ends of the first contact elements are inserted into the passageways of the mounting portion from the third face thereof for electrically engaging with the corresponding second contact elements. A slot is defined in the fourth face of the mounting portion for receiving a circuit board. The slot is in communication with the passageways whereby the second contact elements partially extend into the slot for electrically engaging with the circuit board. A pair of guide arms extend from the second face of the connector portion for snugly receiving and retaining the mounting portion therebetween.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
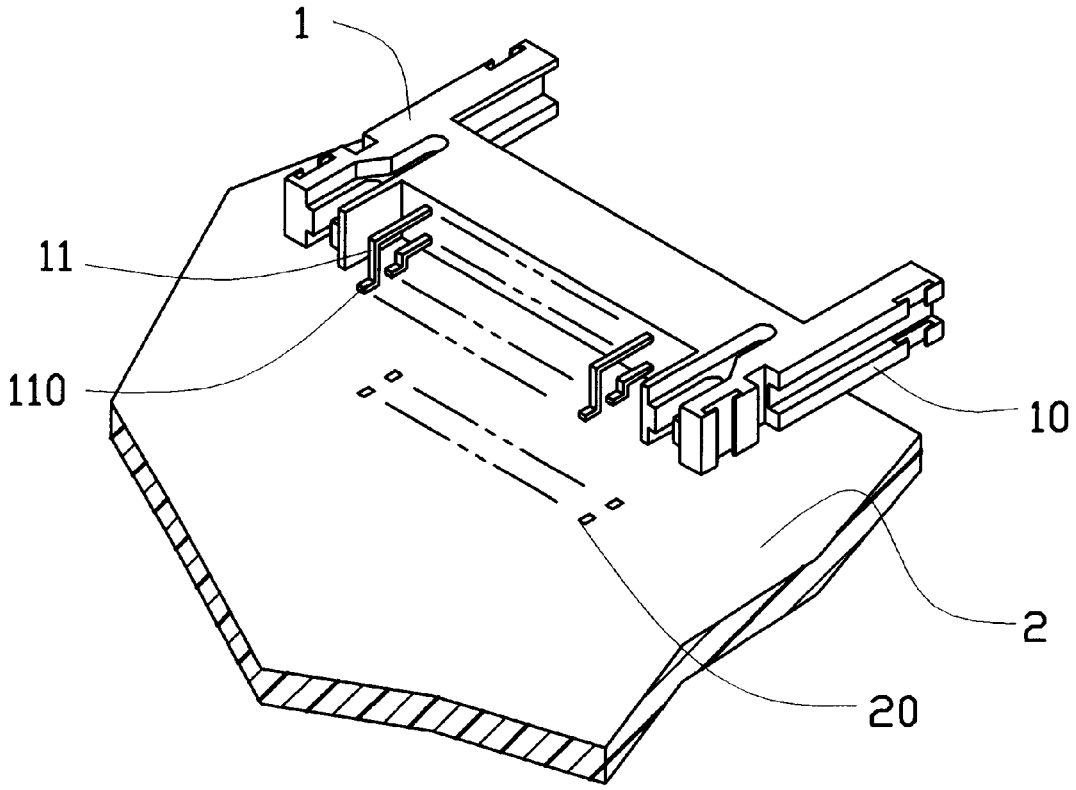
FIG.1 PRIOR ART
FIG. 1 is a perspective view of a conventional electronic card connector mounted to a circuit board.
Figure 2:
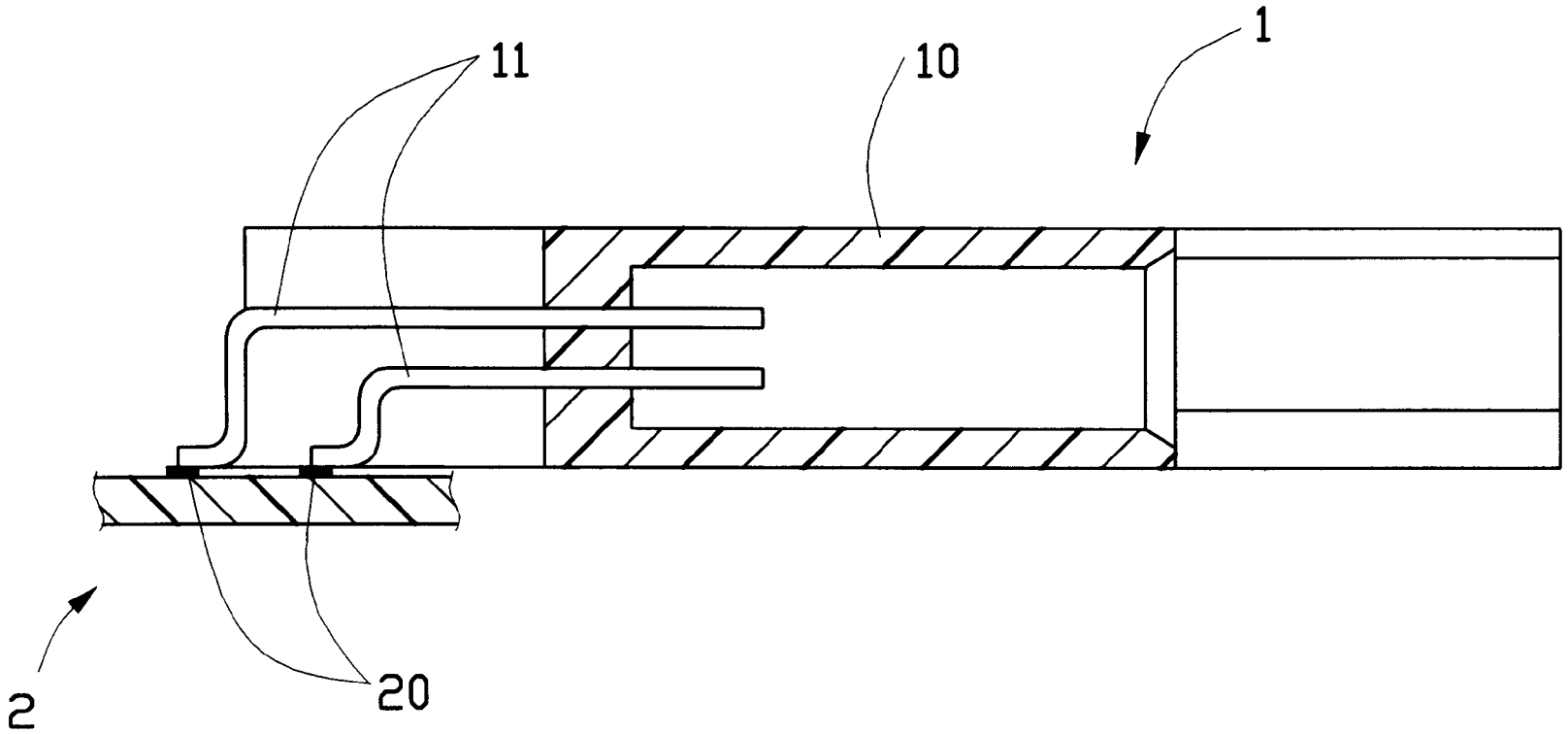
FIG.2 PRIOR ART
FIG. 2 is a cross-sectional view of the conventional electronic card connector.
Figure 3:
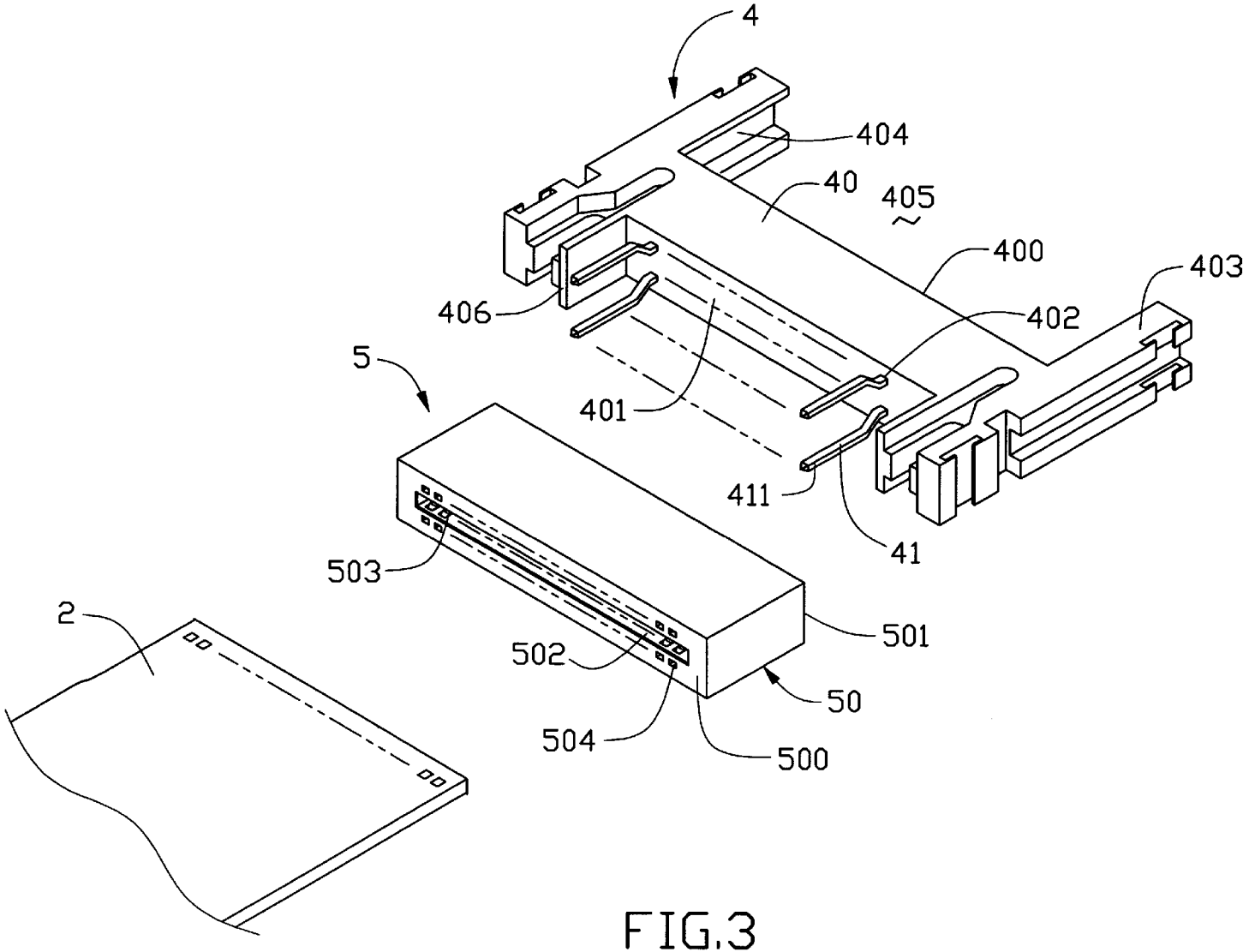
FIG. 3 is an exploded view of an electronic card connector constructed in accordance with the present invention.

Referring to the drawings and in particular to FIG. 3, an electronic card connector in accordance with the present invention comprises a mounting device 5 adapted to be mounted to a circuit board 2 and a connector portion 4 adapted to receive and engage with an electronic card (not shown). The connector portion 4 is releasably connected to the mounting device 5 thereby connecting the electronic card to the circuit board 2.

Figure 4:
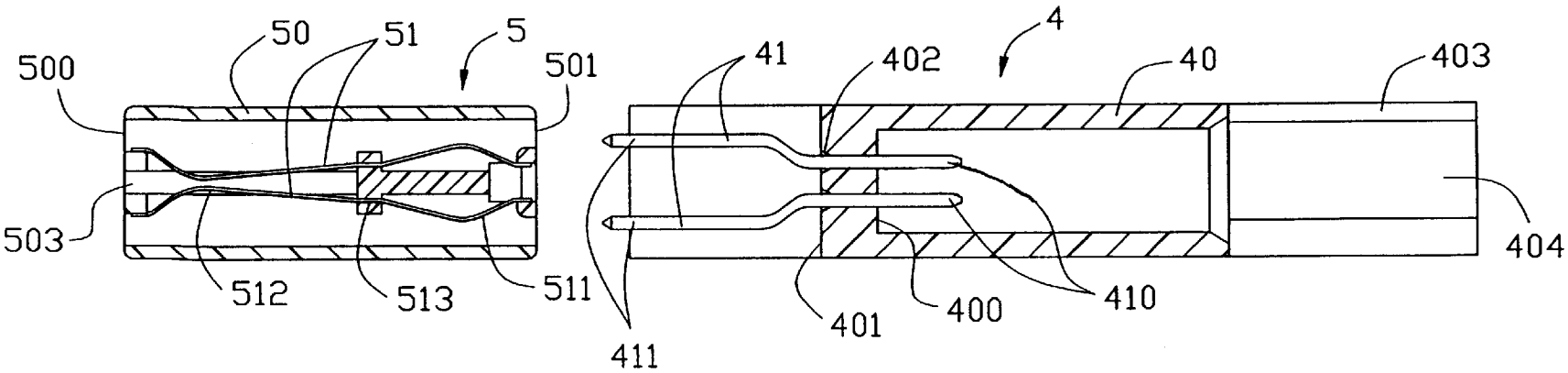
FIG. 4 is a cross-sectional view showing a connector portion of the electronic card connector detached from a mounting device thereof.

Also referring to FIG. 4, the connector portion 4 comprises an insulative header 40 and two first guide arms 403 extending from opposite ends thereof and defining a space 405 therebetween adapted to receive the electronic card therein. Each first guide arm 403 defines a channel 404 in an inside face thereof for guiding the electronic card into the space 405. The header 40 has a rear face 400 extending between the first guide arms 403 and an opposite front face 401. A plurality of first passageways 402 is defined in the header 40 between the front and rear faces 401, 400 for receiving and retaining first contact elements 41. Each first contact element 41 has a card engaging end 410 extending beyond the rear face 400 and a mating end 411 extending beyond the front face 401 for engaging with the mounting device 5.

Figure 5:
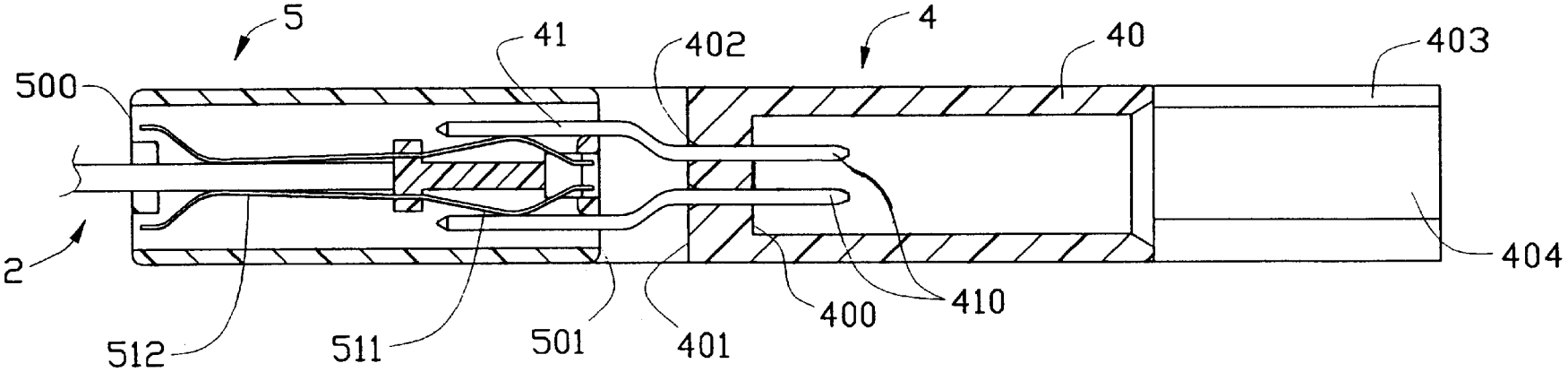
FIG. 5 is similar to FIG. 4 showing the connector portion mounted to the mounting device.

The mounting device 5 comprises an insulative housing 50 having a rear face 501 for mating with the front face 401 of the header 40 of the connector portion 4 and an opposite front face 500. A board receiving slot 503 is defined in the front face 500 for insertion of the circuit board 2. A plurality of second passageways 504 is defined in the housing 50 between the front and rear faces 500, 501 and in communication with the board receiving slot 503. Second contact elements 51 are received in the second passageways 504. Each second contact element 51 has a fixed section 513 fixed in the housing 50, a first engaging section 511 and a second engaging section 512 extending into the board receiving slot 503 for electrically engaging with the circuit board 2 (FIG. 5).

The connector portion 4 is mounted to the mounting device 5 with the mating ends 411 of the first contact elements 41 inserted into the second passageways 504 from the rear face 501 of the mounting device 5 and electrically engaged with the first engaging sections 511 of the second contact elements 51 thereby establishing electrical connection between the circuit board 2 and the first contact elements 41 via the second contact elements 51.

Preferably, two second guide arms 406 extend from the front face 401 of the header 40 of the connector portion 4 for snugly receiving the mounting device 5 therebetween thereby securely retaining the connector portion 4 to the mounting device 5.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electronic card connector comprising:

a connector portion comprising an insulative header defining a plurality of first passageways therein between a front face and a rear face for receiving and retaining first contact elements therein, each first contact element having a card engaging end extending beyond the rear face for being adapted to electrically engage with an electronic card and a mating end extending beyond the front face; and a mounting portion mountable to a circuit board, the mounting portion comprising a housing defining a board receiving slot in a front face thereof receiving the circuit board therein and a rear face mating with the front face of the connector portion, a plurality of second passageways being defined in the housing and in communication with the board receiving slot, second contact elements being received in the second passageways, partially extending into the board receiving slot and electrically engaging with the circuit board, the mating ends of the first contact elements of the connector portion being releasably inserted into the second passageways from the rear face of the housing and electrically engaging with the corresponding second contact elements;

wherein the connector portion comprises first guide arms extending from the rear face thereof and being adapted to receive the electronic card therebetween; and wherein the connector portion comprises two second guide arms extending from the front face thereof for snugly receiving the mounting portion therebetween.

* * * * *